US005428329A

United States Patent [19]

Grunert

[11] Patent Number: 5,428,329

[45] Date of Patent: Jun. 27, 1995

[54] SPRINGCLIP MEANS FOR A LATCHABLE OPERATING MECHANISM ON A CIRCUIT BREAKER

[75] Inventor: Kurt A. Grunert, Beaver, Pa.

[73] Assignee: Eaton Corporation, Cleveland, Ohio

[21] Appl. No.: 247,936

[22] Filed: May 24, 1994

[51] Int. Cl.[6] ..... H01H 9/20

[52] U.S. Cl. ..... 335/167

[58] Field of Search ..... 335/167–176

[56] References Cited

U.S. PATENT DOCUMENTS 3,815,059 6/1974 Spoelman .
4,630,019 12/1986 Maier et al. .
4,642,430 2/1987 Tedesco .
4,642,431 2/1987 Tedesco et al. .
4,644,120 2/1987 Tedesco .
4,650,944 3/1987 Tedesco et al. .
4,888,570 12/1989 Toda ..... 335/167
4,958,136 9/1990 Maier et al. .
4,963,846 10/1990 Grunert et al. .
5,023,582 6/1991 Williams et al. ..... 335/172
5,193,043 3/1993 Grunert et al. .

*Primary Examiner*—Lincoln Donovan
*Attorney, Agent, or Firm*—Martin J. Moran

[57] ABSTRACT

A springclip for use on a changa lever of a latchable operating mechanism in a circuit breaker. The springclip is attached to the changa lever to dampen vibration thereof so that undesired disengagement of the changa lever from the projection of a trip bar of the circuit breaker is resisted.

5 Claims, 4 Drawing Sheets

SPRINGCLIP MEANS FOR A LATCHABLE OPERATING MECHANISM ON A CIRCUIT BREAKER

BACKGROUND OF THE INVENTION

This invention relates to a circuit breaker and more particularly to an improved latchable operating mechanism in which the changa lever includes a springclip member attached thereto to dampen vibrations which are created in the circuit breaker that cause undesired arbitrary opening of the circuit breaker.

Circuit breakers provide protection for electrical systems from electrical fault conditions such as current overloads and short circuits. Typically, circuit breakers include a spring powered operating mechanism which opens electrical contacts to interrupt the current through the conductors on an electrical system in response to abnormal currents. The operating mechanism is unlatched by a trip bar which in turn is operated by a trip mechanism associated with each phase of the electrical system. The trip mechanism can include a magnetic trip device comprising a fixed magnetic structure energized by the current flowing through the conductor, and a movable armature which is attracted toward the stationary magnetic structure to operate the trip bar. The trip bar in turn unlatches the operating mechanism to open the electrical contacts in each phase of the electrical system. The movable armature is biased away from the stationary magnetic structure by a spring thereby forming a gap between the armature and the stationary magnetic structure in the absence of an abnormal current.

In one type of circuit breaker, the trip bar includes a projection which when the circuit breaker is in a closed position engages against a portion of a changa lever. This portion is biased against the trip bar projection so that when the trip bar is rotated, this portion moves. This movement ultimately causes the latch lever of the latchable operating mechanism to become unlatched from the cradle of the over center toggle mechanism which in turn opens the electrical contacts to interrupt the circuit. The projection and the portion of the changa lever have surface-to-surface contact at a small (approximately 1/32 inch) contact area. Because of this, vibrations in the circuit breaker, caused, for example, when the circuit breaker is reset from an open to a closed position, can cause undesired disengagement of the projection from the changa lever thus leading to arbitrary opening of the circuit breaker.

What is needed, therefore, is a means to dampen vibrations in the changa lever to resist undesired disengagement of the changa lever from the trip bar projection, while at the same time maintaining acceptable performance of the changa lever.

SUMMARY OF THE INVENTION

The springclip means of the invention has met the above-mentioned need. The springclip means is attached to the changa lever of the latchable operating mechanism of the circuit breaker to dampen vibration thereof so that undesired disengagement of the changa lever from the projection of the trip bar is resisted.

The circuit breaker of the invention comprises electrical contacts operable between a closed position in which a circuit is completed through the conductor and an open position in which the circuit through the conductor is interrupted and a latchable operating mechanism including manually engageable handle means having a cradle, the latchable operating mechanism operable to open the electrical contacts when the cradle is unlatched. The circuit breaker further comprises a trip bar rotatable from a biased position to a trip position, the trip bar including a projection operatively associated with the latchable operating mechanism and a trip assembly responsive to the abnormal current through the conductor to rotate the trip bar to a trip position and interrupt the circuit. The latchable operating mechanism includes a frame, changa lever means pivotably mounted to the frame, latch lever means engaging the changa lever means and the springclip means as described above which is attached to the changa lever means.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
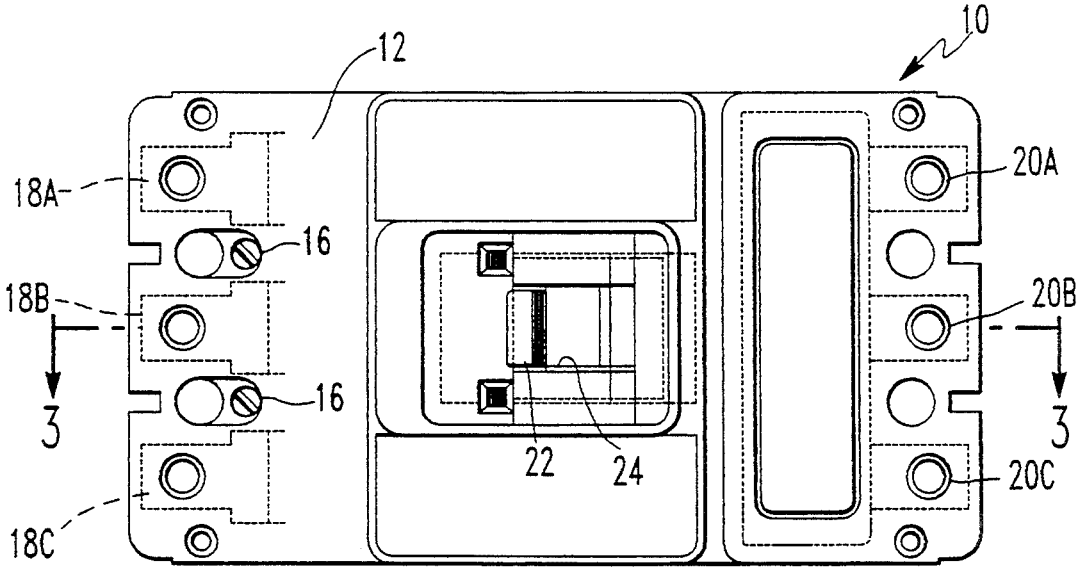
FIG. 1 is a top plan view of a circuit breaker incorporating the invention.
Figure 2:
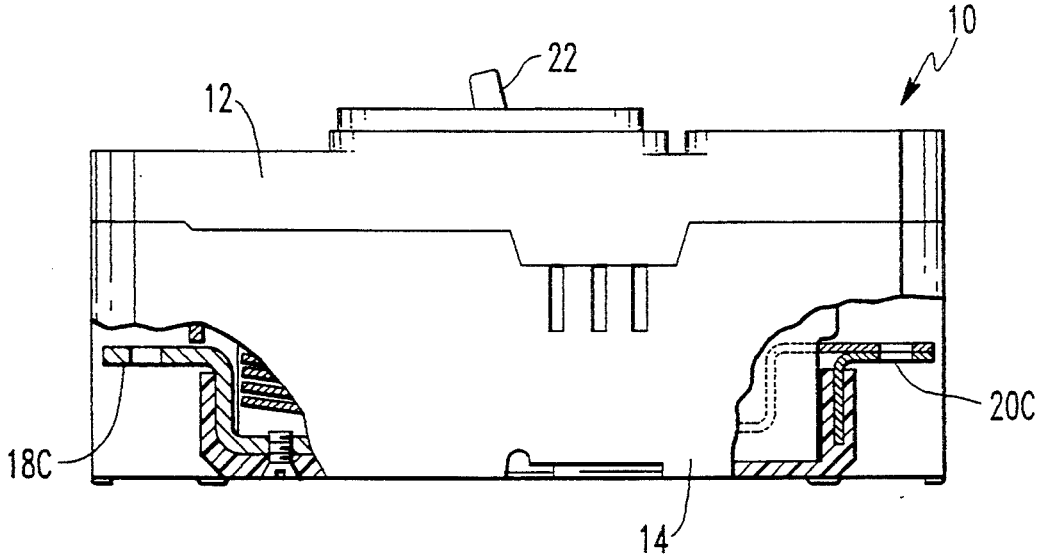
FIG. 2 is a side elevational view of the circuit breaker of FIG. 1.

Referring now to FIGS. 1 and 2, there is shown a molded case circuit breaker 10 constructed in accordance with the invention. While the circuit breaker 10 is depicted and described herein as a three-phase or three-pole circuit breaker, the principles of the present invention disclosed herein are equally applicable to single phase or other polyphase circuit breakers and to both AC circuit breakers and DC circuit breakers.

The circuit breaker 10 includes a molded, electrically insulating top cover 12 mechanically secured to a molded electrically insulating, bottom cover or base 14 by a plurality of fasteners 16. A plurality of first electrical terminals or line terminals 18A, 18B, 18C are provided, one for each pole or phase, as are a plurality of second electrical terminals or load terminals 20A, 20B and 20C. These terminals are used to serially electrically connect the circuit breaker 10 into a three-phase electrical circuit for protecting a three-phase electrical system.

The circuit breaker 10 further includes an electrically insulating, rigid, manually engageable handle 22 extending through an opening 24 in the top cover 12 for setting the circuit breaker 10 to its closed position or to its open position. The circuit breaker may also assume a tripped position. Subsequent to moving to its tripped position, the circuit breaker 10 may be reset for further protective operation by moving the handle 22 from its tripped position to and beyond its open position. The handle 22 may then be left in its open position or moved to its closed position, in which case the circuit breaker 10 is ready for further protective operation. The movement of the handle 22 may be achieved either manually or automatically by a mechanical actuator.

Figure 3:
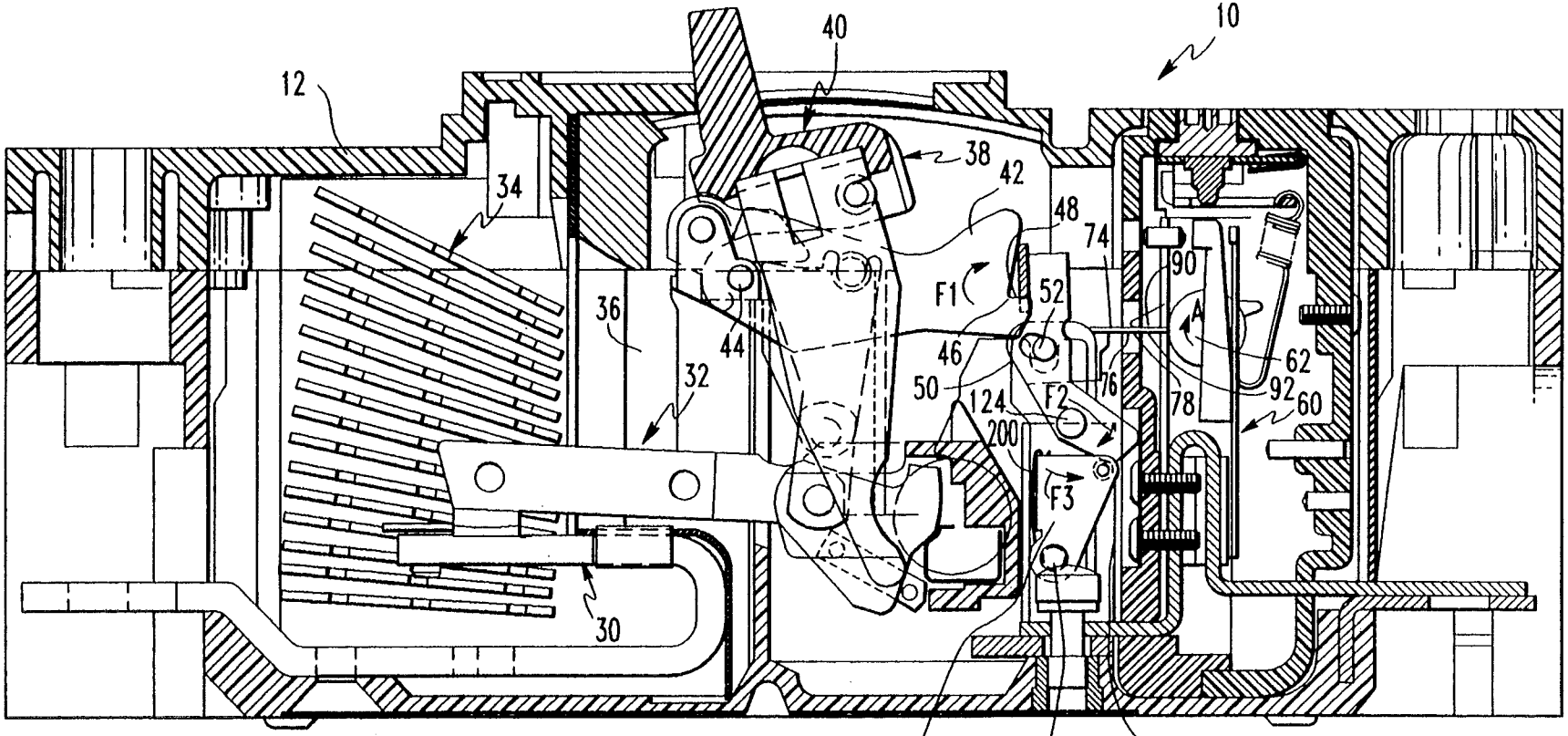
FIG. 3 is a vertical section through the circuit breaker of FIG. 1 taken along line 3—3 of FIG. 1 and illustrating the circuit breaker in the closed position.

Referring now to FIG. 3, the major internal parts of the circuit breaker 10 include a lower contact assembly 30, upper electrical contact 32, an electrical arc chute 34, a slot motor 36 and an operating mechanism 38. All of these parts are conventional and will not be described in detail herein, but are described in detail in U.S. Pat. No. 4,642,430, which is expressly incorporated by reference herein.

The operating mechanism 38 includes a conventional over center toggle mechanism 40 which will also not be described in detail herein but which is also described in detail in U.S. Pat. No. 4,642,430. Briefly, the over center toggle mechanism 40 includes a rigid, one piece metal cradle 42 of elongated configuration that is rotatable about the longitudinal axis of a cradle support pin 44. The cradle 42 is terminated at one end by an elongated surface 46 having a slightly inclined downwardly surface 48 formed therein. This surface 48 is configured to engage the upper portion of the latch lever means 50. The latch lever means 50 pivots about a stationary pin 52 of the trip mechanism upon a trip operation initiated by the magnetic trip assembly 60.

The magnetic trip assembly 60 shown in FIG. 3 is conventional and includes an armature and a stationary magnetic structure (not shown). For details of a magnetic trip assembly, reference is made to U.S. Pat. No. 4,958,136 which is also incorporated by reference herein. As is well known, the magnetic trip assembly detects both low level short circuit or fault current conditions. Upon the detection of any such condition the trip bar 62 is rotated clockwise (arrow A) to initiate a trip operation of the operating mechanism 38.

Referring still to FIG. 3, the latchable operating mechanism 38 consists of a latch lever means 50, and a changa lever means 70. The changa lever means 70 is pivotably mounted to a framing member (not shown) that is permanently secured in the circuit breaker 10. The changa lever means 70, as can also be seen in FIG. 5, includes an upper section 74 that terminates in a nose portion 76. The nose portion 76 has a free edge 78 that is biased against an edge 90 of a trip bar projection 92 that extends from the trip bar 62.

In the closed position as shown in FIG. 3, an upward lifting force from the cradle 42 is applied to the latch lever means 50. Due to the configuration of elongated surface 46 of the cradle 42 and the position of the latch lever means 50, a rotation force F1 is applied to the latch lever means 50. This in turn causes the latch lever means 50 to pivot about pin 52 and thus causes a force F2 to be applied at the latch lever means 50. This in turn creates a force F3 that rides over the roller of the changa lever means 70 thus biasing the nose portion 76 of the changa lever means 70 against the projection 92 of the trip bar 62.

Figure 4:
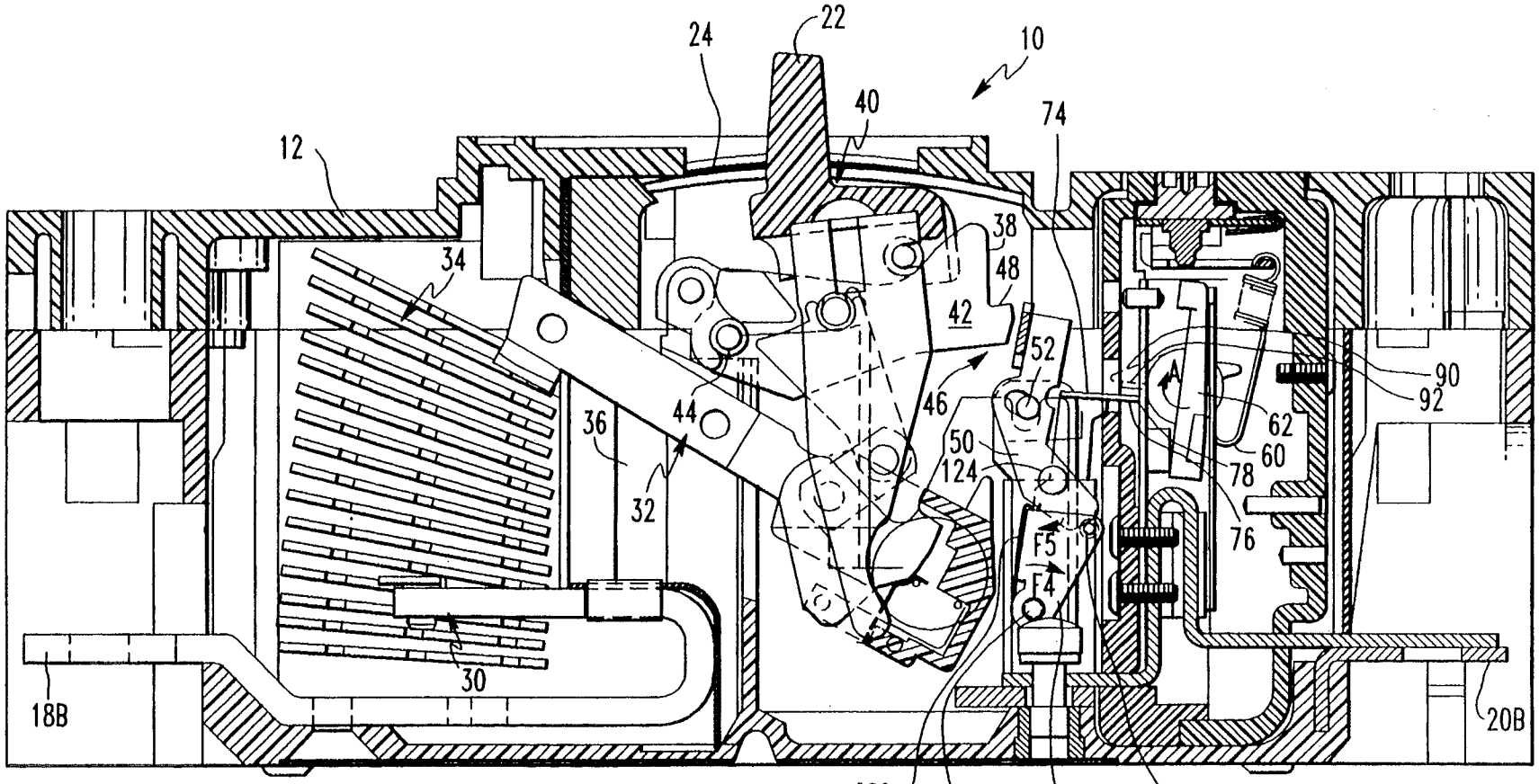
FIG. 4 is a detailed vertical sectional view of the latch lever means and the changa lever means similar to FIG. 3 and showing the tripping of the circuit breaker by the rotation of the trip bar.

Referring now to FIG. 4, when the magnetic trip assembly causes the trip bar 62 to rotate clockwise (arrow A), the nose portion 76 and thus the entire changa lever means 70, because it is biased against the trip bar projection 92, becomes disengaged from the trip bar projection 92 and the nose portion 76 moves underneath the trip bar projection 92. This in turn causes the changa lever means 70 to rotate about the changa lever bearing 120 in the direction of arrow F4. This in turn causes the latch lever means 50 to move in the direction of arrow F5, because the latch lever means 50 is biased against the roller 122 of the changa lever means 70. The latch lever means 50 rotates about bearing pin 124 thus causing the upper portion of the latch lever means 50 to become unlatched from the inclined surface 48 of the cradle 42. Finally, this causes the over center toggle switch to open the electrical contacts and thus interrupt the circuit.

It will be appreciated that different types of trip assemblies, such as electronic trip mechanisms, can also be used in association with the invention.

Figure 5:
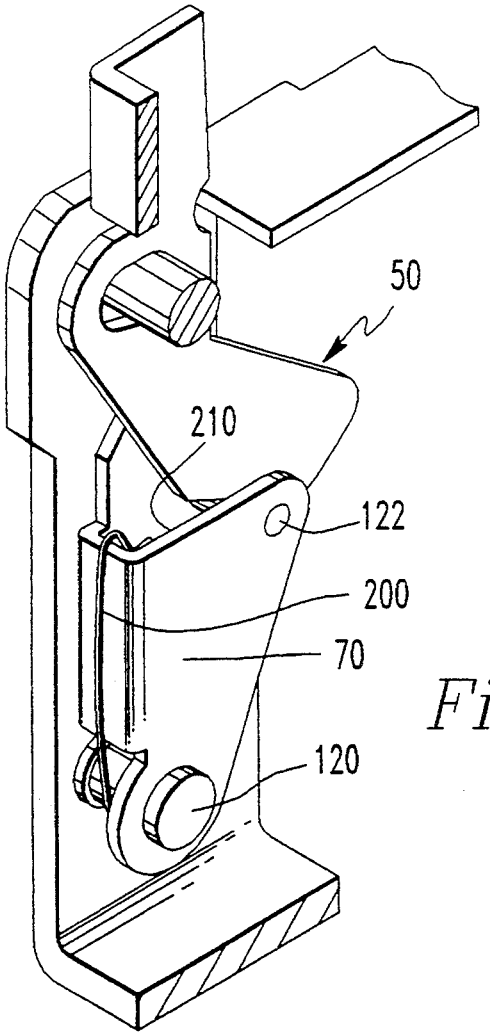
FIG. 5 is a perspective view of a portion of the changa lever means showing the springclip attached thereto.
Figure 6:
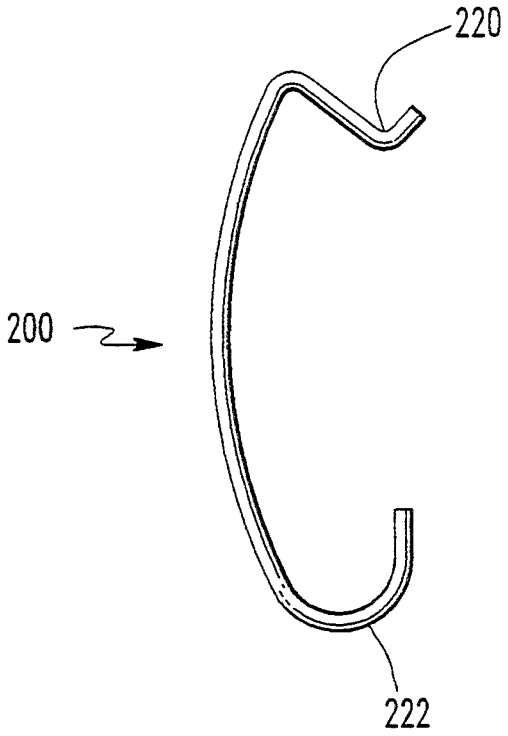
FIG. 6 is a side elevational view of the springclip means.

Referring now to FIGS. 3–6 and more particularly to FIGS. 5 and 6, the springclip means 200 of the invention will be discussed. The springclip means 200 is attached to the back side 210 of the changa lever means 70. The springclip means is generally in the form of a "C" having retaining dips 220 and 222 at each end thereof to facilitate attachment to the changa lever means 70. As shown in FIGS. 3 and 5, the retaining dip 220 clips onto the changa lever means. Retaining dip 222 is attached to the changa lever bearing 120 of the changa lever means 70. The springclip means 200 dampens vibrations in the changa lever means 70 which are caused by, for example, resetting the circuit breaker from an open to a closed position. These vibrations, in generally the up/-down direction, are universally undesirable because they may lead to inadvertent and undesired disengagement of the nose portion 76 of the changa lever means 70 from the trip bar projection 92. This leads to tripping the circuit breaker arbitrarily.

The springclip means 200 is preferably integrally formed and is made of a suitable resilient engineering material, such as stainless steel wire. The wire can have a circular cross-sectional shape and is preferably between about 0.020 to 0.040 inches in diameter. The material, shape and configuration of the springclip means 200 facilitates easy attachment thereof to the changa lever means 70.

The springclip means 200 effectively dampens unwanted up and down movement of the changa lever means 70 while at the same time maintaining acceptable and responsive movement of the changa lever means. That is, the springclip means 200 dampens vibrations while still allowing free rotation of the changa lever means about the changa lever bearing 120 as required for the action of the latch lever means 50 during its operation. This result is accomplished without adjustment of the bearings of the latch lever means or the changa lever means which can result in sluggish operation thereof. The springclip means 200 can be attached at the final assembly of the circuit breaker 10 or even after the trip assembly is installed in the circuit breaker housing.

It will be appreciated that a springclip means for a latchable operating mechanism on a circuit breaker has been disclosed which can be used to dampen vibrations which are created in the circuit breaker that cause undesired arbitrary opening of the circuit breaker.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker for responding to abnormal currents in a conductor in an electrical system, said circuit breaker comprising:

electrical contacts operable between a closed position in which a circuit is completed through said conductor and an open position in which said circuit through said conductor is interrupted;

a latchable operating mechanism including a cradle, said latchable operating mechanism operable to open said electrical contacts when said cradle is unlatched;

a trip bar rotatable from a biased position to a trip position, said trip bar including a projection operatively associated with said latchable operating mechanism;

a trip assembly responsive to said abnormal current through said conductor to rotate said trip bar to said trip position and interrupt said circuit; and said latchable operating mechanism further comprising:

a frame;

changa lever means pivotably mounted to said frame and biased against said projection of said trip bar such that when said trip bar is rotated to said trip position, said changa lever means disengages from said projection and pivots with respect to said frame;

latch lever means engaging said changa lever means such that when said changa lever means pivots, said latch lever means moves and is unlatched from said cradle; and springclip means attached to said changa lever means to dampen vibration thereof so that undesired disengagement of said changa lever means from said projection is resisted.

2. The circuit breaker of claim 1, wherein said springclip means is shaped generally in the form of a "C", having retaining dips at each end thereof in order to facilitate attachment of said springclip means to said changa lever means.

3. The circuit breaker of claim 2, wherein said springclip means is integrally formed.

4. The circuit breaker of claim 3, wherein said springclip means is made of a resilient material such that it may be securely attached to said changa lever means.

5. The circuit breaker of claim 2, wherein said changa lever means is pivotably mounted to said frame by bearing shaft means; and one end of said springclip means is hooked around said bearing shaft means such that free rotation of said bearing shaft is permitted while at the same time undesired vibrations in said changa lever means are resisted.

* * * * *